US012389969B2

(12) United States Patent
Jones et al.

(10) Patent No.: US 12,389,969 B2
(45) Date of Patent: Aug. 19, 2025

(54) HELMET FOR MONITORING RIDER CONDITION

(71) Applicant: Western Power Sports, LLC, Boise, ID (US)

(72) Inventors: Michael K. Jones, Boise, ID (US); Jeremy Len Lathrop, Meridian, ID (US)

(73) Assignee: Western Power Sports, LLC, Boise, ID (US)

( * ) Notice: Subject to any disclaimer, the term of this patent is extended or adjusted under 35 U.S.C. 154(b) by 0 days.

(21) Appl. No.: 17/927,417

(22) PCT Filed: Aug. 31, 2022

(86) PCT No.: PCT/US2022/042248

§ 371 (c)(1),
(2) Date: Nov. 23, 2022

(87) PCT Pub. No.: WO2023/034445

PCT Pub. Date: Mar. 9, 2023

(65) Prior Publication Data

US 2024/0237776 A1 Jul. 18, 2024

Related U.S. Application Data

(60) Provisional application No. 63/239,845, filed on Sep. 1, 2021.

(51) Int. Cl.
*A42B 3/04* (2006.01)
*A42B 3/30* (2006.01)
(Continued)

(52) U.S. Cl.
CPC ..... *A42B 3/046* (2013.01); *A42B 3/30* (2013.01); *A42B 3/00* (2013.01); *A42B 3/0433* (2013.01); *A42B 3/06* (2013.01); *A42B 3/12* (2013.01)

(58) Field of Classification Search
CPC ..... A42B 3/12; A42B 3/06; A42B 3/0433; A42B 3/00; A42B 3/30; A42B 3/046
(Continued)

(56) References Cited

U.S. PATENT DOCUMENTS 4,833,726 A 5/1989 Shinoda et al.
5,119,505 A * 6/1992 Tisseront ..... A42B 3/127 455/350

(Continued)

FOREIGN PATENT DOCUMENTS

CA 2023088 C 12/2000
CN 110403289 A 11/2019

(Continued)

OTHER PUBLICATIONS

International Search Report and Written Opinion of International Application No. PCT/US2022/042248 mailed on Dec. 6, 2022, 16 Pages.

(Continued)

*Primary Examiner* — Khaled Annis
*Assistant Examiner* — Dakota Marin
(74) *Attorney, Agent, or Firm* — Lowe Graham Jones PLLC

(57) ABSTRACT

The present disclosure relates to a helmet for monitoring a plurality of conditions of a wearer and a method thereof. The helmet comprises an outer shell, an inner padding arrangement, a plurality of sensors, an electronic device, and one or more indicators. The plurality of sensors are configured to detect a plurality of parameters of the wearer and further configured to generate a first set of signals. The first set of signals correspond to at least one condition of the wearer. The electronic device is configured to generate a second set of signals based on the first set of signals, which are indicated by the one or more indicators. Hence, the one or (Continued)

more indicators are configured to indicate a detected condition of the wearer. Such indication facilitates a third person or first responders to know the condition of the wearer without any additional components.

21 Claims, 14 Drawing Sheets

(51) Int. Cl.
*A42B 3/00* (2006.01)
*A42B 3/06* (2006.01)
*A42B 3/12* (2006.01)

(58) Field of Classification Search
USPC ..... 2/410
See application file for complete search history.

(56) References Cited

U.S. PATENT DOCUMENTS 5,142,700 A * 8/1992 Reed ..... H04B 1/385 455/344
5,871,271 A 2/1999 Chien
6,826,509 B2 11/2004 Crisco, III et al.
7,303,302 B2 * 12/2007 Harris ..... A42B 3/0406 362/802
7,386,401 B2 6/2008 Vock et al.
7,526,389 B2 4/2009 Greenwald et al.
8,001,623 B2 8/2011 Gertsch et al.
8,232,881 B2 7/2012 Hertz
8,554,509 B2 10/2013 Crisco, III et al.
9,007,217 B1 4/2015 Anvari
9,075,405 B1 7/2015 Anvari
9,226,707 B2 1/2016 Huang
9,247,779 B1 * 2/2016 Aloumanis ..... A42B 3/0426
9,445,639 B1 9/2016 Aloumanis et al.
9,451,795 B2 9/2016 Krueger
9,451,802 B2 * 9/2016 Shearman ..... H04N 5/91
9,549,583 B2 1/2017 Pietrzak et al.
9,596,901 B1 3/2017 Anvari
9,597,567 B1 3/2017 Tran et al.
9,622,661 B2 4/2017 Crisco, III et al.
9,787,892 B2 * 10/2017 Henn ..... A42B 3/046
9,861,151 B2 1/2018 Ciaramelletti et al.
9,900,669 B2 2/2018 Touma et al.
9,943,128 B2 * 4/2018 Atashbar ..... A42B 3/0433
10,045,740 B2 8/2018 John
10,064,444 B2 * 9/2018 Glezerman ..... A42B 3/12
10,105,076 B2 10/2018 Chu et al.
10,123,582 B2 11/2018 Crossman et al.
10,271,606 B2 4/2019 Auerbach
10,390,579 B2 8/2019 Zukowski
10,586,437 B1 3/2020 Slavin et al.
10,653,199 B2 5/2020 Olivares Velasco
10,736,370 B2 8/2020 Chen et al.
10,827,795 B2 11/2020 Miller, II
10,873,837 B2 12/2020 Tran et al.
10,945,601 B2 3/2021 Greenwald et al.
11,696,610 B2 * 7/2023 Lange ..... A42B 3/06 2/422
12,059,047 B2 * 8/2024 Becker ..... A42B 3/30
2013/0144175 A1 6/2013 Lambert et al.
2014/0115759 A1 * 5/2014 Tomlin ..... A63B 69/002 340/689
2016/0058092 A1 3/2016 Aldino et al.
2016/0106174 A1 4/2016 Chung et al.
2016/0210834 A1 7/2016 Dayal
2017/0006955 A1 1/2017 Dow, II
2017/0172243 A1 6/2017 Scripa et al.
2018/0289095 A1 * 10/2018 Catterson ..... A42B 3/0453
2019/0142097 A1 5/2019 Moor
2019/0166945 A1 6/2019 Martin
2020/0037693 A1 * 2/2020 Klimek ..... A42B 3/30
2020/0060374 A1 2/2020 Glover et al.
2020/0345095 A1 * 11/2020 Olivares Velasco ..... A61B 5/6803
2021/0005072 A1 1/2021 Dinkins
2021/0052029 A2 2/2021 Becker et al.
2021/0145450 A1 5/2021 Gruentzig

FOREIGN PATENT DOCUMENTS

CN 210581168 U 5/2020
CN 211608337 U 10/2020
CN 212994760 U 4/2021
DE 102011115193 A1 3/2013
EP 3123454 A1 2/2017
EP 3509047 B1 7/2020
EP 3801099 A1 4/2021
ES 2610034 A1 4/2017
FR 2722370 A1 1/1996
IN 201741046325 A 6/2019
IN 201941040483 4/2021
KR 101960722 B1 3/2019
WO 2010/116017 A1 10/2010
WO 2018/050037 A1 3/2018
WO 2020/072825 A1 4/2020
WO 2020/095337 A1 5/2020
WO 2020/123873 A1 6/2020
WO 2020/217089 A1 10/2020

OTHER PUBLICATIONS

Veena divya Krishnappa et al., A Compact Sensor System for Concussion Mitigation in Helmets—A Concept Prototype, Jan. 2015, 3 Pages.
Sreenithy Chandran et al., Konnect: An Internet of Things (IoT) Based Smart Helmet for Accident Detection and Notification, Dec. 2016, 2 Pages, IEEE Annual India Conference.
Ali Youssef et al., Towards Model-Based Online Monitoring of Cyclist's Head Thermal Comfort Smart Helmet Concept and Prototype, Aug. 2019, 11 Pages.
Mohd Khairul Afiq Mohd Rasli et al., Smart Helmet with Sensors for Accident Prevention, Dec. 5, 2013, 3 Pages, 2013 ICEESE, Kuala Lumpur, Malaysia.
Yiyang Zhuang et al., Fiber Optic Sensor Embedded Smart Helmet for Real-Time Impact Sensing and Analysis through Machine Learning, Journal of Neuroscience Methods, Mar. 1, 2021, 23 Pages, vol. 351.
Bethany Rowson et al., Chapter 23—Measuring Head Impacts: Accelerometers and Other Sensors, Handbook of Clinical Neurology, 2018, pp. 235-243, vol. 158.
David E. Krzeminski et al., Development of a Pressure Sensor Platform for Direct Measurement of Head Injury Criterion (HIC), ScienceDirect, Procedia Engineering 112 (2015), pp. 190-195.
H.C. Impana et al., A Review on Smart Helmet for Accident Detection Using IOT, EAI Endorsed Transactions on Internet of Things, May 14, 2020, 6 Pages.
Sofia Henriksson, Concept Development of Communications-Enabled Motorcycle Helmet, Master of Science Thesis Stockholm, Sweden 2008, 75 Pages.

* cited by examiner

HELMET FOR MONITORING RIDER CONDITION

PRIORITY CLAIMS

This invention claims priority to PCT Application No. PCT/US22/42248 filed Aug. 31, 2022, which claims priority to U.S. provisional application Ser. No. 63/239,845, filed Sep. 1, 2021. The contents of which are hereby incorporated by reference.

FIELD OF THE DISCLOSURE

The present disclosure generally relates to helmets. More particularly, the present disclosure relates to a helmet for monitoring one or more conditions of a wearer.

BACKGROUND

Use of different protective gear while riding a vehicle is well-known. For example, knee pads, elbow pads, helmets, chest protectors, etc. are used for protection of different body parts of a wearer or a rider. Helmets, especially, are very important while riding a vehicle on roads or in different sports, as they protect the head of the wearer in case of accident. There are different types of helmets available to choose from. For instance, a helmet used while riding a bike or a motorcycle for day-to-day travel is designed differently as compared to a helmet used for sports, such as a racing event or technical off-road riding. The helmet used for sports is specially designed to have extra protection in case of an impact or crash during the racing event.

There have been many developments in design of the helmets used in sporting events. Some examples of such developments are use of different materials to absorb shock or impact force in case an accident, a shape of the helmet, a breathability of wearer of the helmet, and the like. However, such helmets fail to indicate different conditions of a wearer. For instance, it is not possible to determine whether the wearer has their biometric data in predefined range without any external communication. Further, in case of accident during the racing event, such helmets do not indicate a level of injury the wearer has suffered, or any kind of indication to first responders so that they can know and be ready for a possible action beforehand.

SUMMARY OF THE DISCLOSURE

In some embodiments, the present disclosure sets forth a helmet for monitoring a plurality of conditions of a wearer. The helmet comprises an outer shell, an inner padding arrangement, a plurality of sensors, an electronic device, and one or more indicators. The outer shell defines an outer shape of the helmet, and comprises an outer surface, an inner surface, a front part, a rear part, a first side part, and a second side part. The inner padding arrangement is configured to receive the wearer's head therewithin. The inner padding arrangement comprises an inner liner and a foam arrangement. The foam arrangement comprises an electronics holder such as a recess. The plurality of sensors are placed within the outer shell and are configured to detect a plurality of parameters associated with the wearer. The plurality of sensors generate a corresponding first set of signals associated with each of the detected plurality of parameters.

The electronic device is communicatively coupled to the plurality of sensors and comprises at least a processing unit and a transceiver. The electronic device is configured to be received within the holder of the inner padding arrangement. The electronic device is configured to receive the first set of signals from the plurality of sensors, and further configured to generate a second set of signals indicative of at least one of the plurality of conditions of the wearer. The one or more indicators are communicatively coupled to the electronic device. The one or more indicators are configured to receive the second set of signals from the electronic device and are further configured to generate a corresponding indication associated with each of the plurality of the conditions of the wearer. The one or more indicators are selected from the group consisting of an audio indicator, a video indicator, and a combination thereof.

In some embodiments, the present disclosure includes a method for monitoring a plurality of conditions of a wearer using a helmet comprising an outer shell, an inner liner, a plurality of sensors, one or more indicators, and an electronic device including a processing unit and a transceiver. The method comprises the steps of detecting one or more parameters of the wearer using the plurality of sensors, thereby generating a first set of signals. The first set of parameters are received by the electronic device. The method further includes the steps of analyzing the first set of signals by the electronic device to determine a condition of the wearer from the plurality of conditions and generating a second set of signals by the electronic device. The second set of signals correspond to the determined condition of the wearer. The second set of signals are received by the one or more indicators. The method includes the step of indicating the detected condition of the wearer from the plurality of conditions on the one or more indicators.

BRIEF DESCRIPTION OF THE DRAWINGS

A more complete understanding of the present disclosure may be derived by referring to the detailed description and claims when considered in connection with the Figures, wherein like reference numerals refer to similar elements throughout the Figures.

DETAILED DESCRIPTION

The following description is of exemplary embodiments of the invention only, and is not intended to limit the scope, applicability, or configuration of the invention. Rather, the following description is intended to provide a convenient illustration for implementing various embodiments of the invention. As will become apparent, various changes may be made in the function and arrangement of the elements described in these embodiments without departing from the scope of the invention as set forth herein. It should be appreciated that the description herein may be adapted to be employed with alternatively configured devices having different shapes, components, attachment mechanisms, and the like and still fall within the scope of the present invention. Thus, the detailed description herein is presented for purposes of illustration only and not of limitation.

Reference in the specification to "one embodiment" or "an embodiment" is intended to indicate that a particular feature, structure, or characteristic described in connection with the embodiment is included in at least an embodiment of the invention. The appearances of the phrase "in one embodiment" or "an embodiment" in various places in the specification are not necessarily all referring to the same embodiment.

According to a first aspect of the present disclosure, an item of protective gear, for instance, a helmet for protection of head of a wearer is disclosed. The term 'wearer' used in the description relates to a rider riding a vehicle and wearing the helmet as disclosed in the present disclosure. Accordingly, the term 'wearer' is used interchangeably used with the term 'rider' without deterring to the scope of the present disclosure. The helmet may be used at a time of having sporting event, such as a racing event. The helmet in accordance with the present disclosure may include different components that may be assembled or may be integral part of the helmet. The helmet may be used to determine a plurality of conditions of a wearer during and/or after a significant event, such as an accident in the racing event. In addition to, or alternatively, the helmet may include features that may be utilized to indicate first responders at the event regarding different condition of the wearer without help of additional tools/components.

Figure 1:
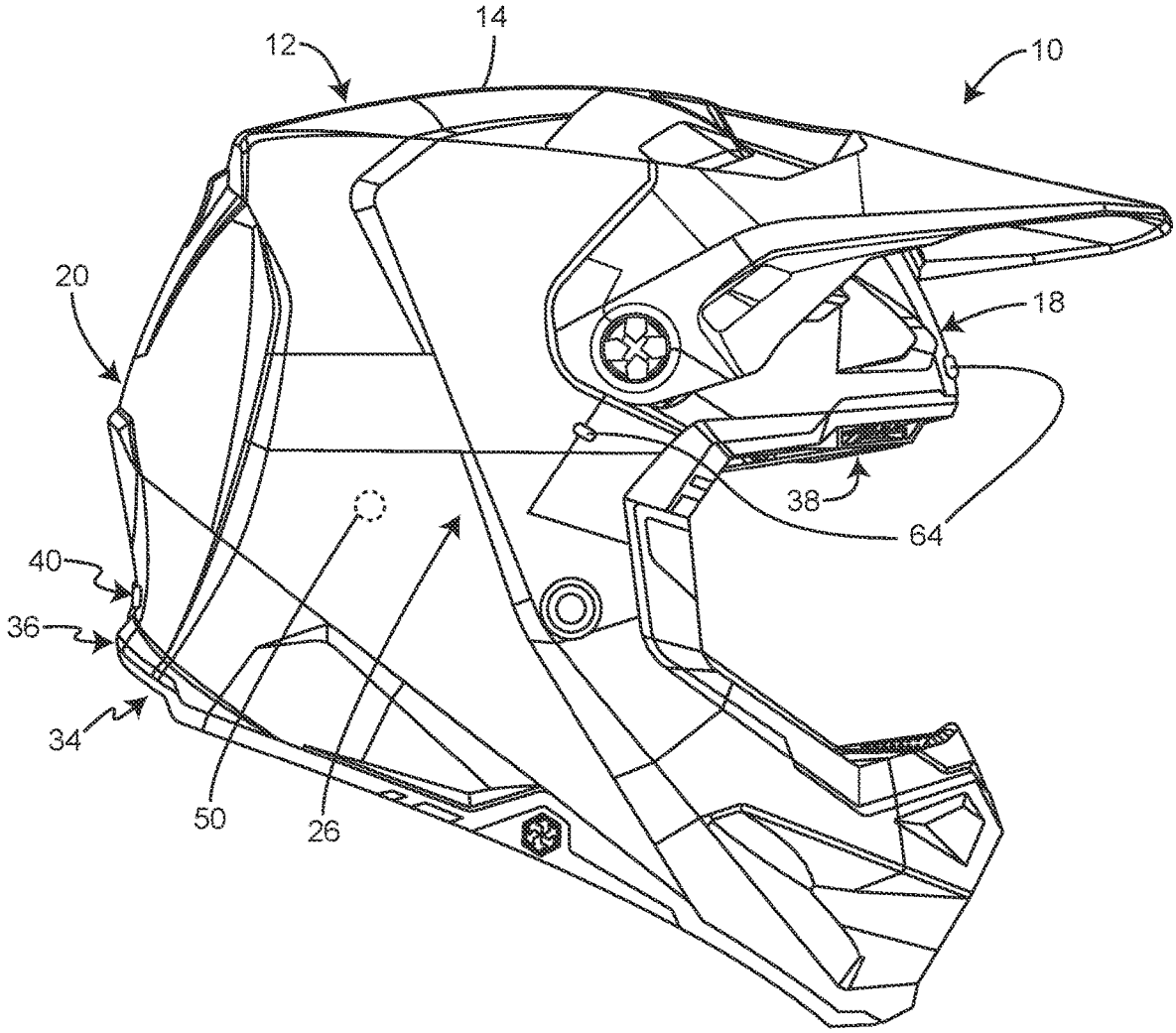
FIGS. 1-2 illustrate a side view and a perspective view, respectively, of a helmet for monitoring a plurality of conditions of a wearer in accordance with the present disclosure.
Figure 2:
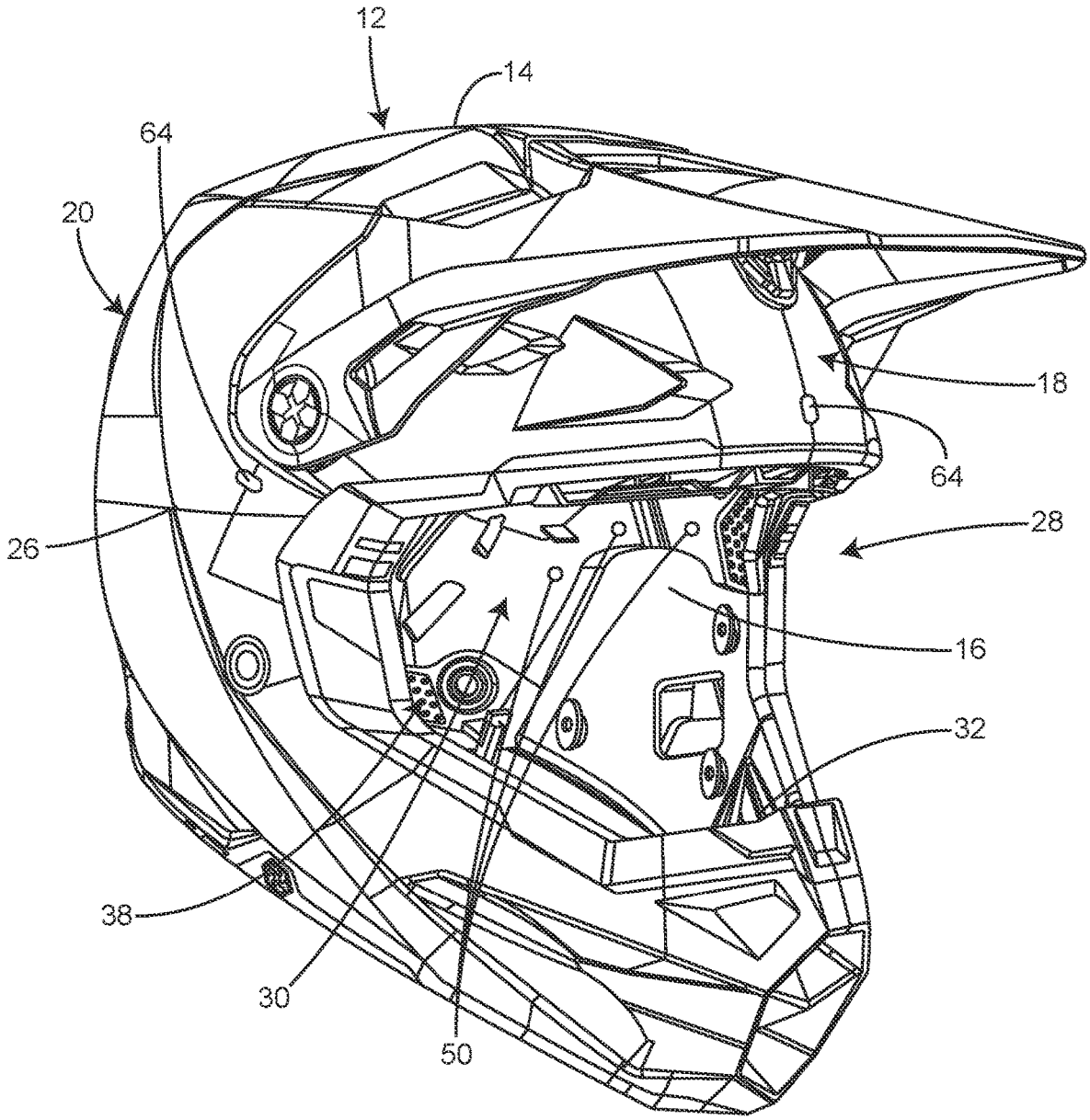
Figure 4:
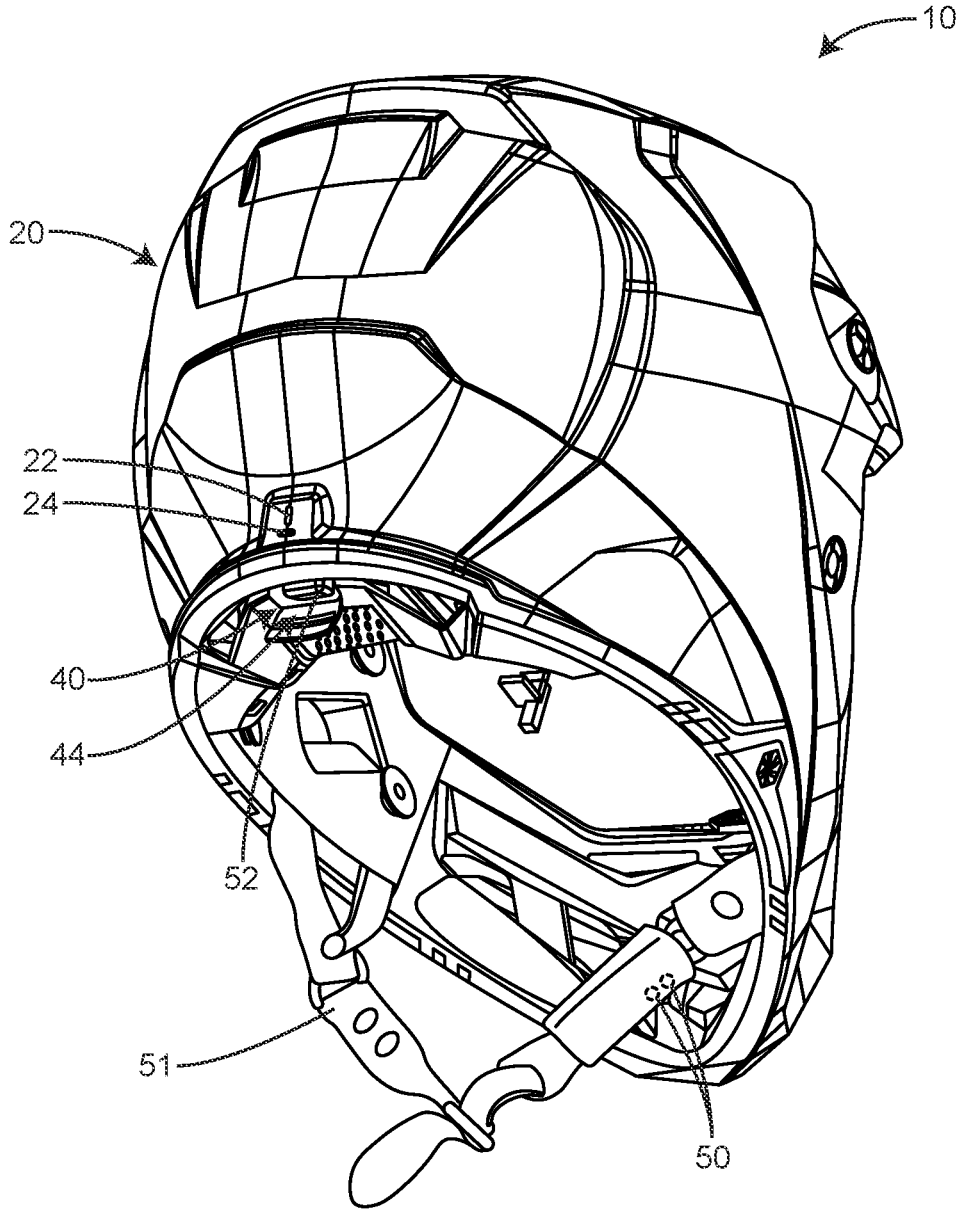
Figure 5:
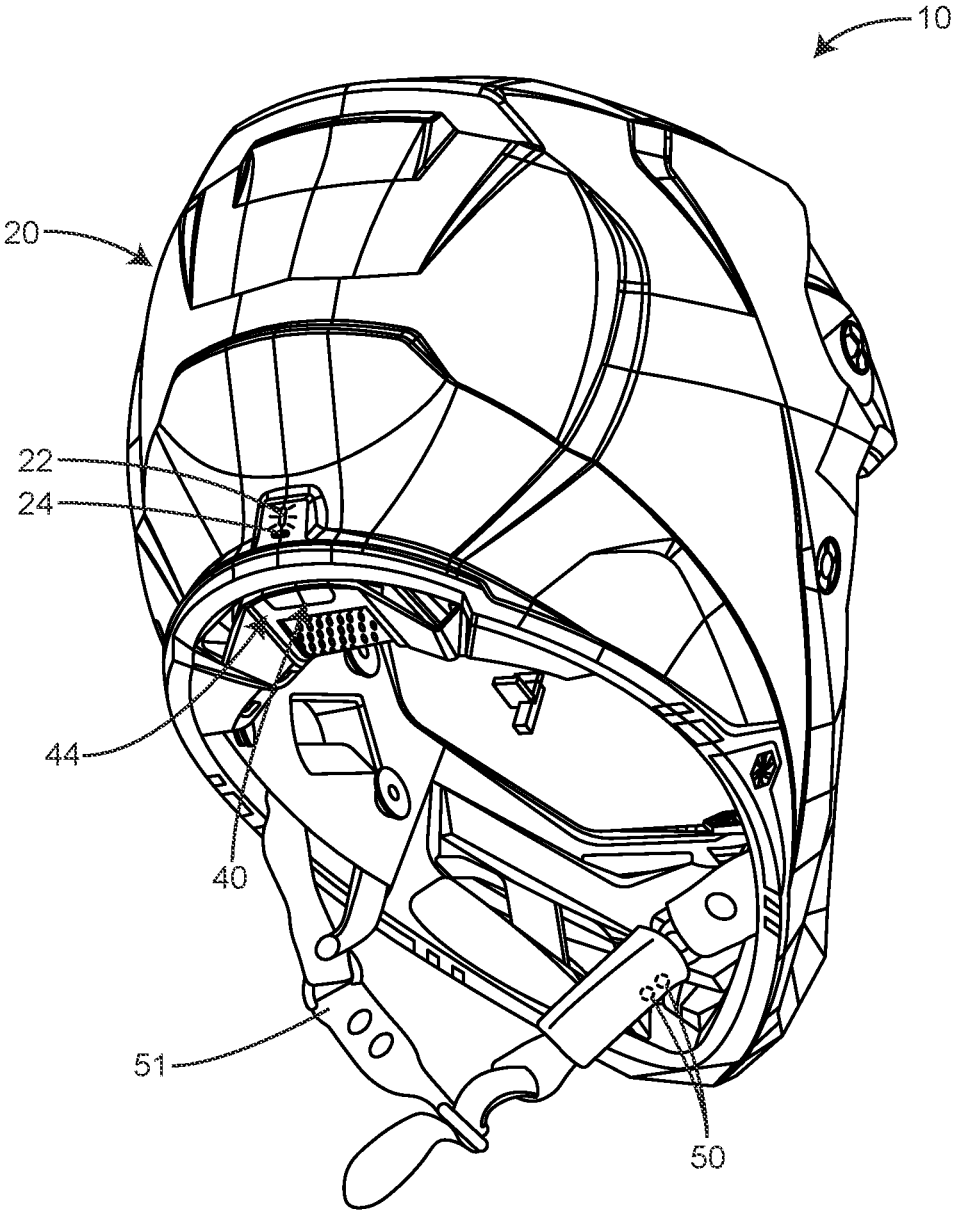

Reference is made to FIGS. 1-2, which illustrate a side view and a perspective view, respectively, of a helmet 10 in accordance with the present disclosure. The helmet 10 comprises an outer shell 12 defining a shape thereof. The outer shell 12 may be defined by an outer surface 14, an inner surface 16, a front part 18, a rear part 20, a first side part 26, and a second side part 28. The inner surface 16 is opposite to the outer surface 14. In some embodiments, the outer shell 12 may comprise different provisions for different accessories. For instance, the outer shell 12 may comprise one or more vents for facilitating air circulation therewithin. Further, the first side part 26, and the second side part 28 of the outer shell 12 may comprise a provision for attaching a visor therewith for facilitating the wearer of the helmet 10 to see a forward path. Furthermore, a chinstrap 51 (seen e.g., in FIGS. 4-5) may be attached to a bottom portion 34 of each of the first side part 26 and the second side part 28 of the outer shell 12 for providing support and better fitting of the helmet 10 over the wearer's head.

The helmet 10 comprises an inner padding arrangement 30. The inner padding arrangement 30 may be configured to have a shape corresponding to the shape of the outer shell 12 and may be configured to receive head of the wearer therewithin. The inner padding arrangement 30 comprises an inner liner 32 and a foam arrangement 38. The inner liner 32 may be configured to be placed adjacent to the inner surface 16 of the outer shell 12. The inner liner 32 may substantially cover the inner surface 16 of the outer shell 12. Accordingly, the inner liner 32 may have a shape substantially equal to the outer shell 12. In some embodiments, the inner liner 32 may be made of a rigid crushable material, such as a closed-cell foam.

In some embodiments, the inner liner 32 may comprise a plurality of channels for receiving the foam arrangement 38 therewithin. Alternatively, the foam arrangement 38 may simply be secured to a generally smooth inner face of the inner liner 32. The foam arrangement 38 may include additional foam (such as an open-cell foam) for providing extra cushioning and protection to the wearer. The additional foam may be placed at different locations within the outer shell 12. For instance, the foam may be attached to an inner side of the inner liner 32 at a first side and a second side corresponding to cheeks of the wearer. The foam may be placed at a back part 36 of the inner liner 32 and adjacent to a bottom portion 34 of the outer shell 12 for providing support to neck of the wearer. The inner padding 30 layer includes a holder 40 (seen e.g., in FIGS. 3-6). The holder 40 may be placed at a suitable location within the helmet 10. In some embodiments, the holder 40 may be placed within or beneath the foam arrangement 38. In a preferred embodiment, the holder 40 may be placed at the back part 36 of the inner liner 32 in a pocket formed therein.

The helmet 10 further comprises a plurality of sensors 50 (seen e.g., in FIGS. 2 and 4-5) for detecting one or more parameters associated with the wearer. Each of the plurality of sensors 50 is configured to detect a respective parameter and is further configured to generate a corresponding signal. In some embodiments, the plurality of parameters may be associated with biometric data of the wearer. Optionally or in addition, the plurality of sensors 50 may be associated with one or more external conditions affecting the wearer, such as external impact or external vibrations. Some non-limiting examples of the plurality of sensors 50 are temperature sensor, heartrate sensor, $VO_2$ measurement sensor, $O_2$ measurement sensor, hydration sensor, accelerometer, and the like. Such sensors may be configured to detect the corresponding parameters of the wearer or impact/movement events of the wearer. In some embodiments, the plurality of sensors 50 may be configured to detect the associated parameters continuously. In other embodiments, the plurality of sensors may be configured to detect the associated parameters at predefined intervals.

The plurality of sensors 50 may be placed at different locations within the outer shell 12. For instance, one or more of the plurality of sensors 50 may be placed at a chinstrap 51 (seen e.g., in FIGS. 4-5) of the helmet 10. Some sensors may be placed within the inner liner 32 to detect shock or vibration. Hence, the plurality of sensors 50 may be configured to detect the plurality of parameters associated with the wearer, for instance, during a racing event. In some embodiments, the plurality of parameters may be detected sequentially in a predefined order. In other embodiments, the plurality of parameters may be detected simultaneously. For example, multiple accelerometers may detect acceleration simultaneously to determine three-dimensional movement/acceleration of the helmet/head of the user. In further embodiments, specific parameters may be detected on specific events, such as an impact event. Moreover, the plurality of sensors 50 may be configured to detect parameters of the wearer after a significant event. For instance, the plurality of sensors 50 may measure heartrate of the wearer after winning or losing the race. Further, in case of an accident, the plurality of sensors 50 may measure parameters such as a force of the impact, heartrate of the wearer immediately after the impact, respiration rate of the wearer after the impact, and the like.

The measured parameters may be used to analyze a condition of the wearer after the significant event. Accordingly, the first set of parameters represent different conditions of the wearer of the helmet 10 during and/or after a significant event. The plurality of conditions of the wearer may be selected from a normal condition, an elevated condition, an underrated condition, and the like. The normal condition may be referred to as a condition in which the plurality of measured parameters are within corresponding predefined range. The elevated condition may be referred to as a condition in which the plurality of measured parameters are more than the corresponding predefined range. The underrated condition may be referred to as a condition in which the plurality of measured parameters are below the corresponding predefined range. The plurality of conditions may further include conditions of the wearer with respect to a level of impact or accident, such as a minor impact, a moderate impact, a severe impact, and the like.

The plurality of sensors 50 are configured to generate a first set of signals associated with the detected parameters. In particular, each of the plurality of sensors 50 may be configured to generate a corresponding signal leading to the first set of signals. In some embodiments, the first set of signals may be a plurality of signals representing corresponding detected parameters. Accordingly, the first set of signals indicates the detected condition of the wearer.

Figure 3:
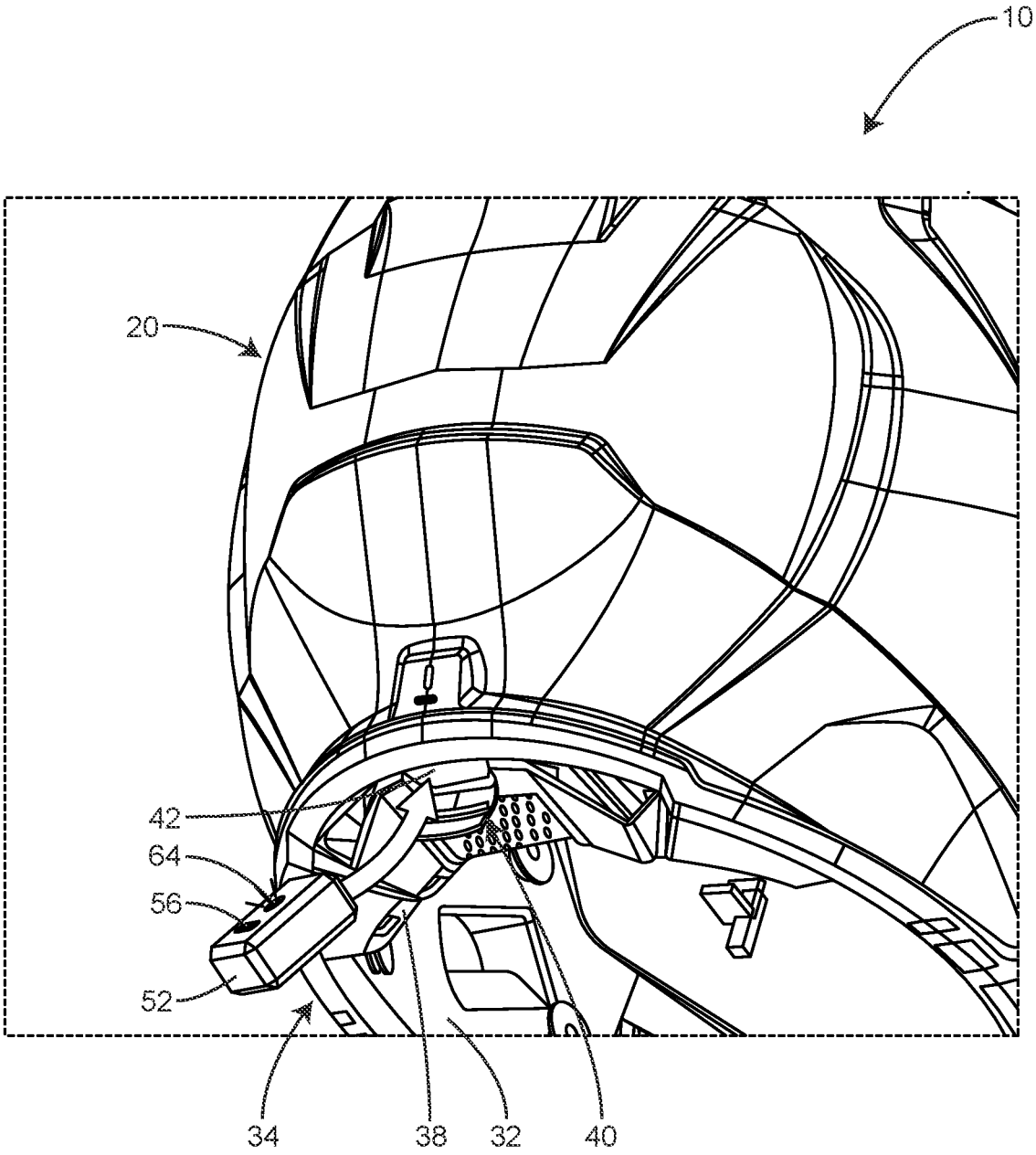
FIGS. 3-5 illustrate exemplary rear views of a helmet having an electronic device in accordance with the present disclosure.
Figure 6:
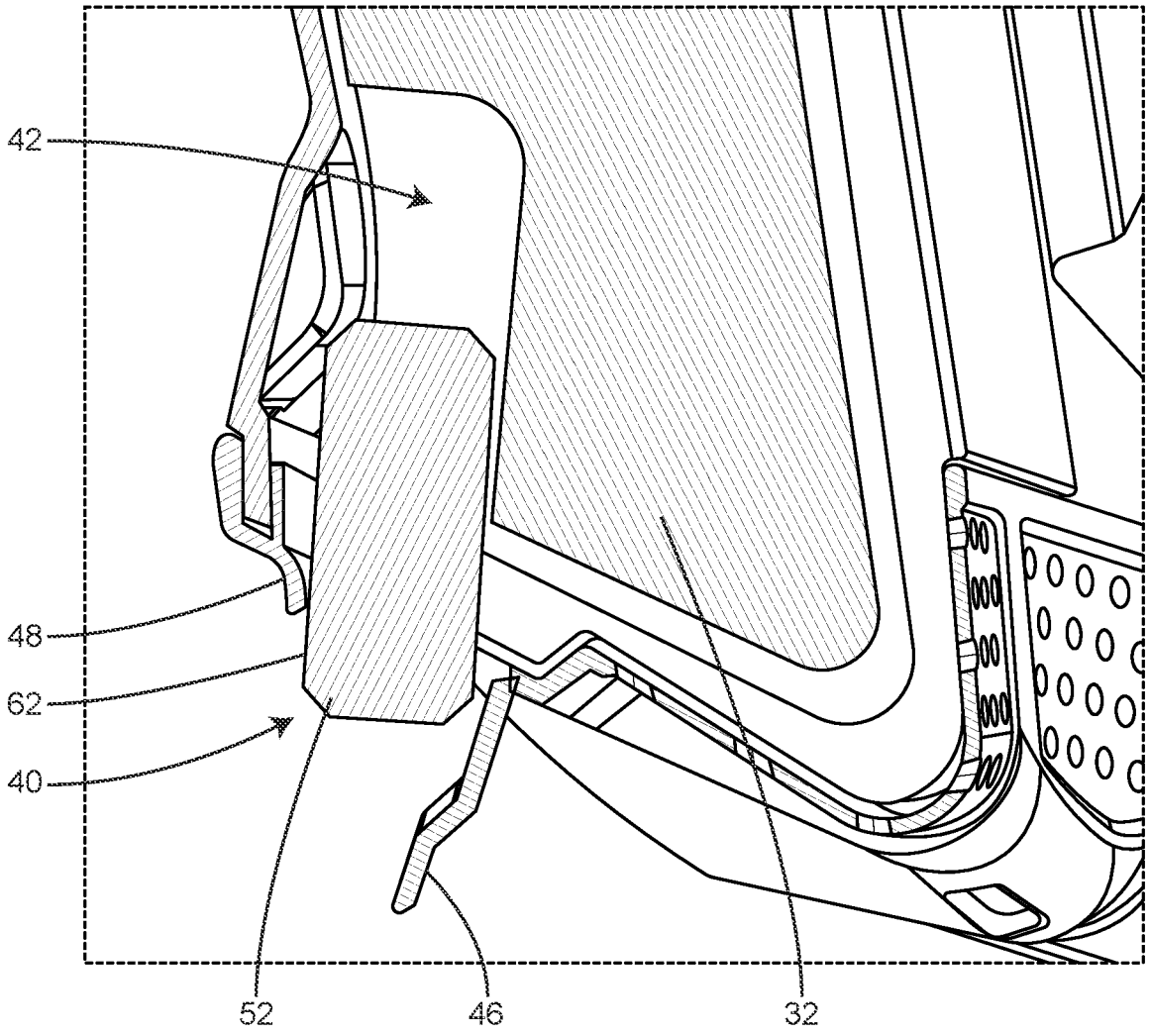
FIGS. 6-7 illustrate exemplary cross-section views of a holder for an electronic device in accordance with the present disclosure.
Figure 7:
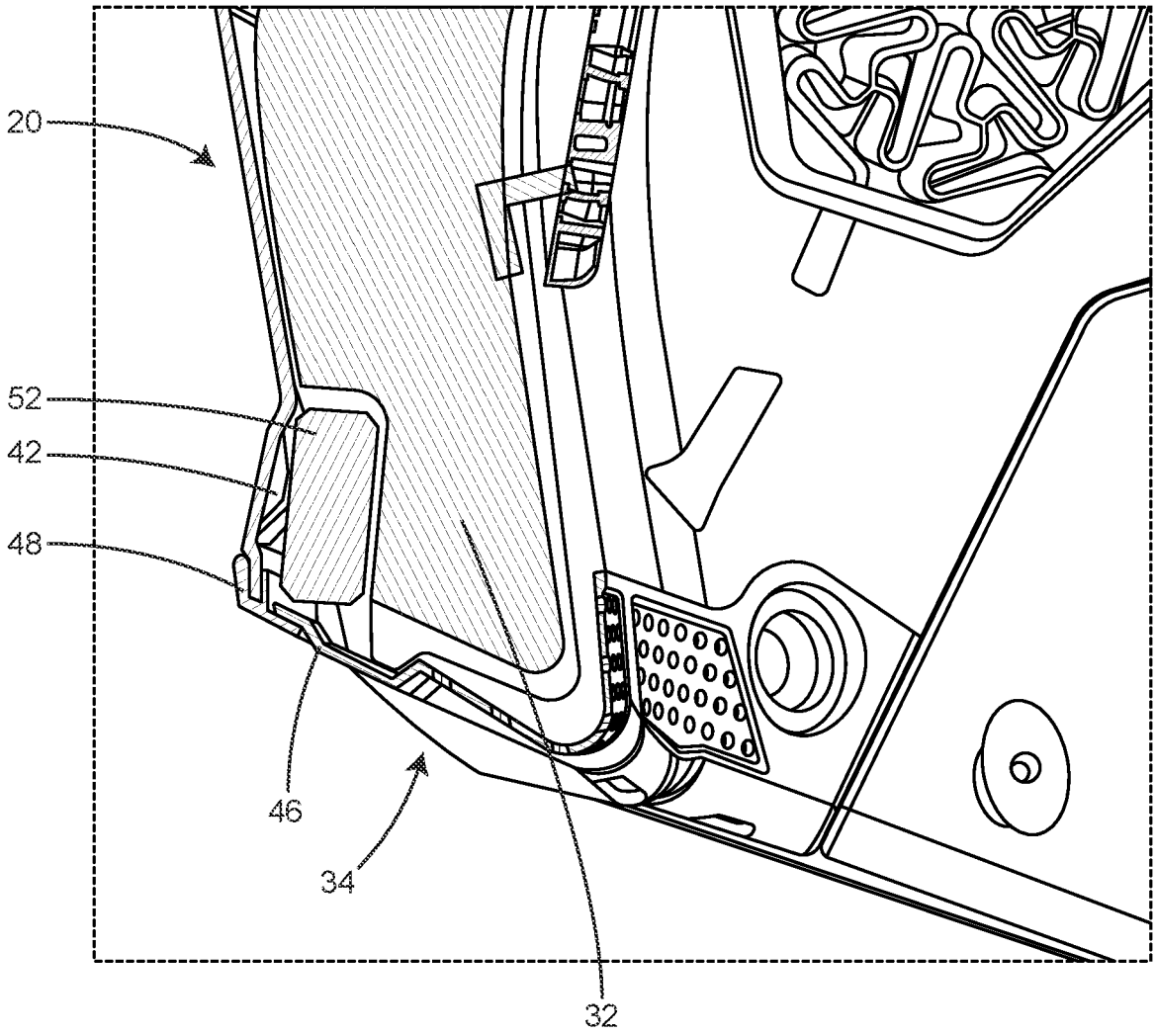

The helmet 10 further comprises an electronic device 52 (seen e.g., in FIGS. 3 and 6-7). The electronic device 52 may be communicatively coupled to the plurality of sensors 50. In some embodiments, the electronic device 52 may be connected to the plurality of sensors 50 using wired connections. In such embodiments, the wires may pass through the channels of the inner liner that are used to receive the additional foam therewithin. In other embodiments, the electronic device 52 may be wirelessly connected to the plurality of sensors 50, e.g., using a Bluetooth communication, or a near-field communication.

The electronic device 52 may be placed within the holder 40 of the inner padding arrangement 30 at the back part 36 at the rear part 20 of the helmet 10 as seen in FIGS. 3-6. In some embodiments, the electronic device 52 may be a chip that can be inserted into the holder 40. In other embodiments, the electronic device 52 may be a small circuit enclosed in a box that can be inserted into the holder 40. In an embodiment, the holder 40 is placed adjacent to a bottom trim 66 of the helmet 10. The holder 40 comprises a cavity 42 and a closing mechanism 44. The cavity 42 and the closing mechanism 44 are configured to completely enclose the electronic device 52 therewithin. In some embodiments, the cavity 42 may be carved within the rigid foam of the inner liner 32. In other embodiments, the cavity 42 may be made of a specific material and may be placed within the additional foam of the foam arrangement 38. An opening of the cavity 42 is configured to be closed using the closing mechanism 44. The closing mechanism 44 comprises a door 46 and a corresponding flap 48 (seen e.g., in FIGS. 6-7). The door 46 may be a hinged door 46 and may be attached to a rigid outer support of the additional foam. The door 46 may be configured to attain a closed position and an open position. In the open position (seen e.g., in FIG. 6), the cavity 42 is open and is able to receive the electronic device 52 therewithin. Once the electronic device 52 is placed within the cavity 42, the door 46 may attain the closed position and the cavity 42 is closed by changing the door 46 to the closed position (seen e.g., in FIG. 7). In the closed position, the door 46 is engaged with the corresponding flap 48. The corresponding flap 48 may be attached to the outer shell 12 at the bottom portion 34 of the rear part 20.

Figure 8:
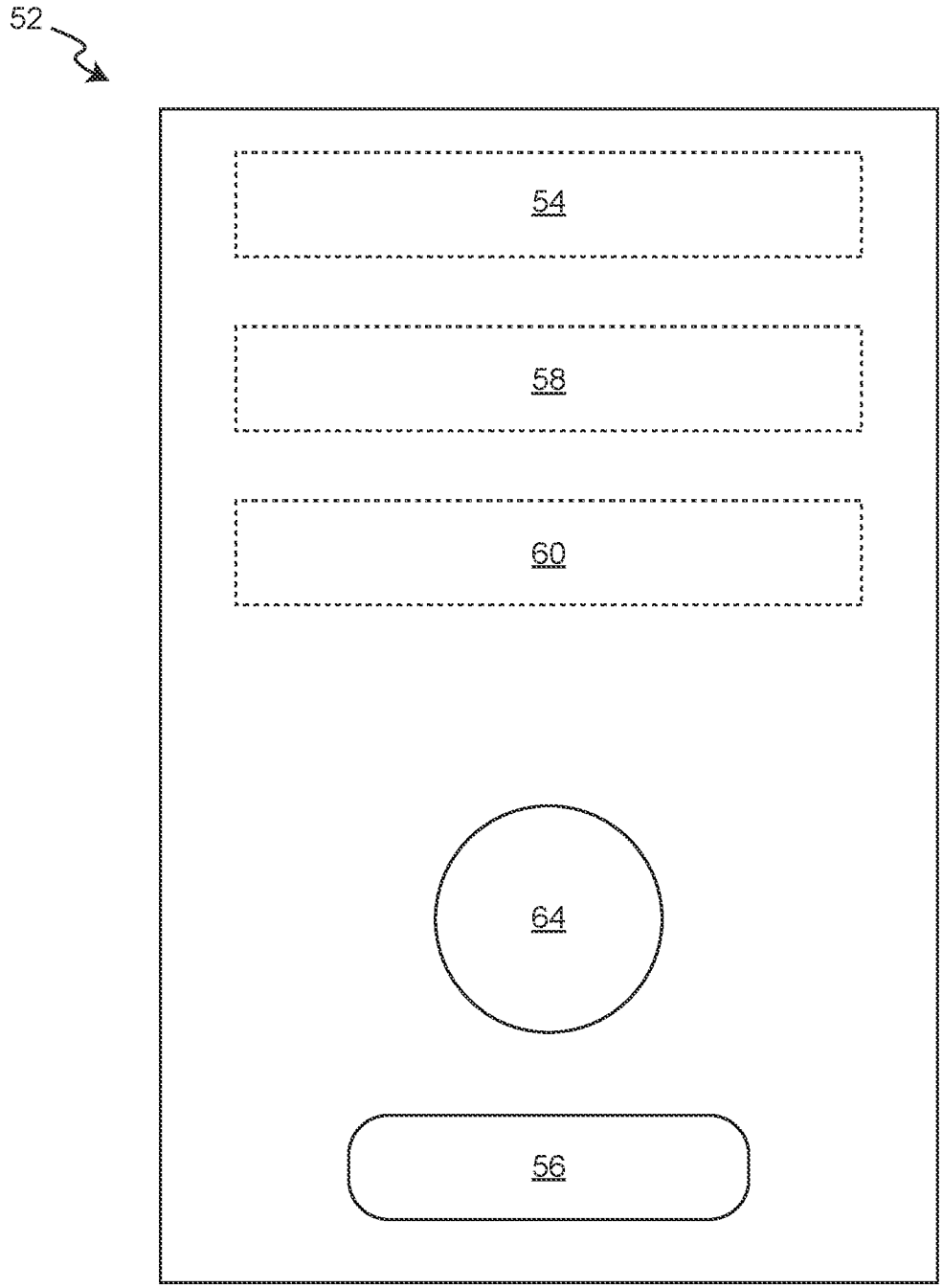
FIG. 8 illustrates an exemplary block diagram of an electronic device of a helmet in accordance with the present disclosure.
Figure 9:
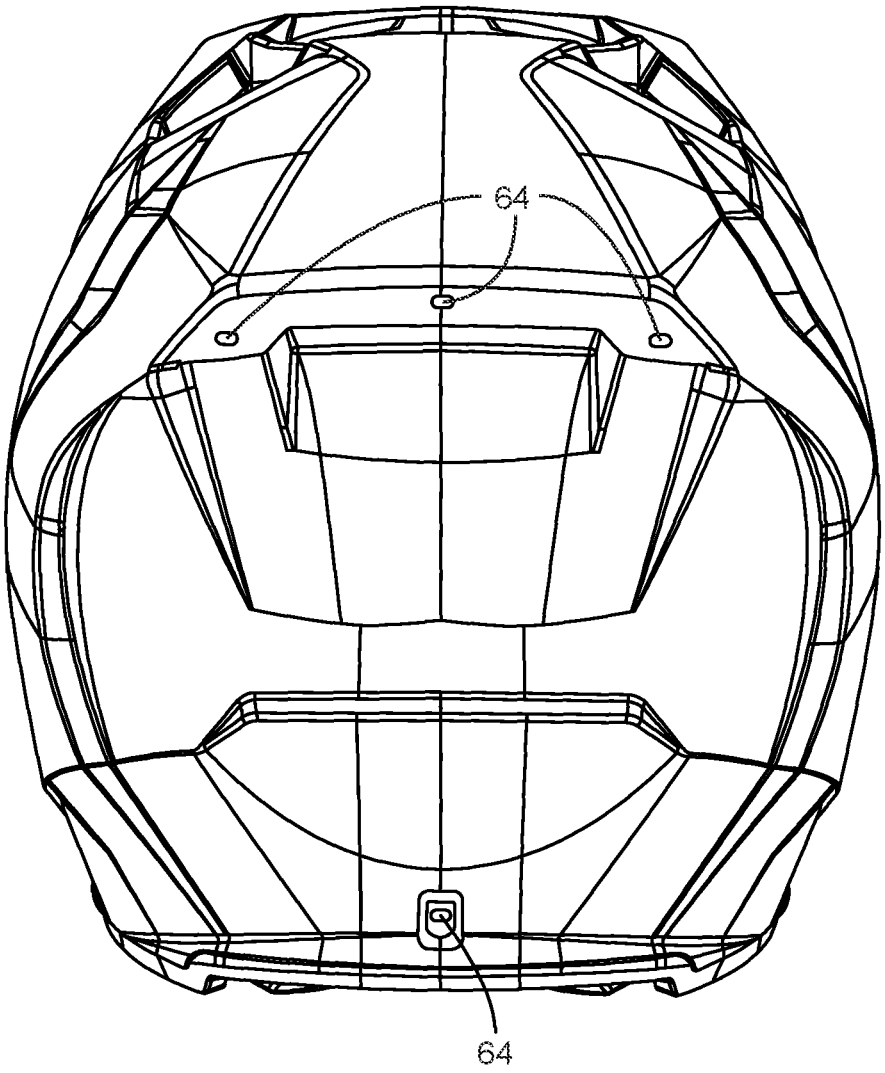
FIGS. 9-12 illustrate exemplary placements of one or more indicators for indicating a plurality of conditions of a wearer on a helmet in accordance with the present disclosure.
Figure 10:
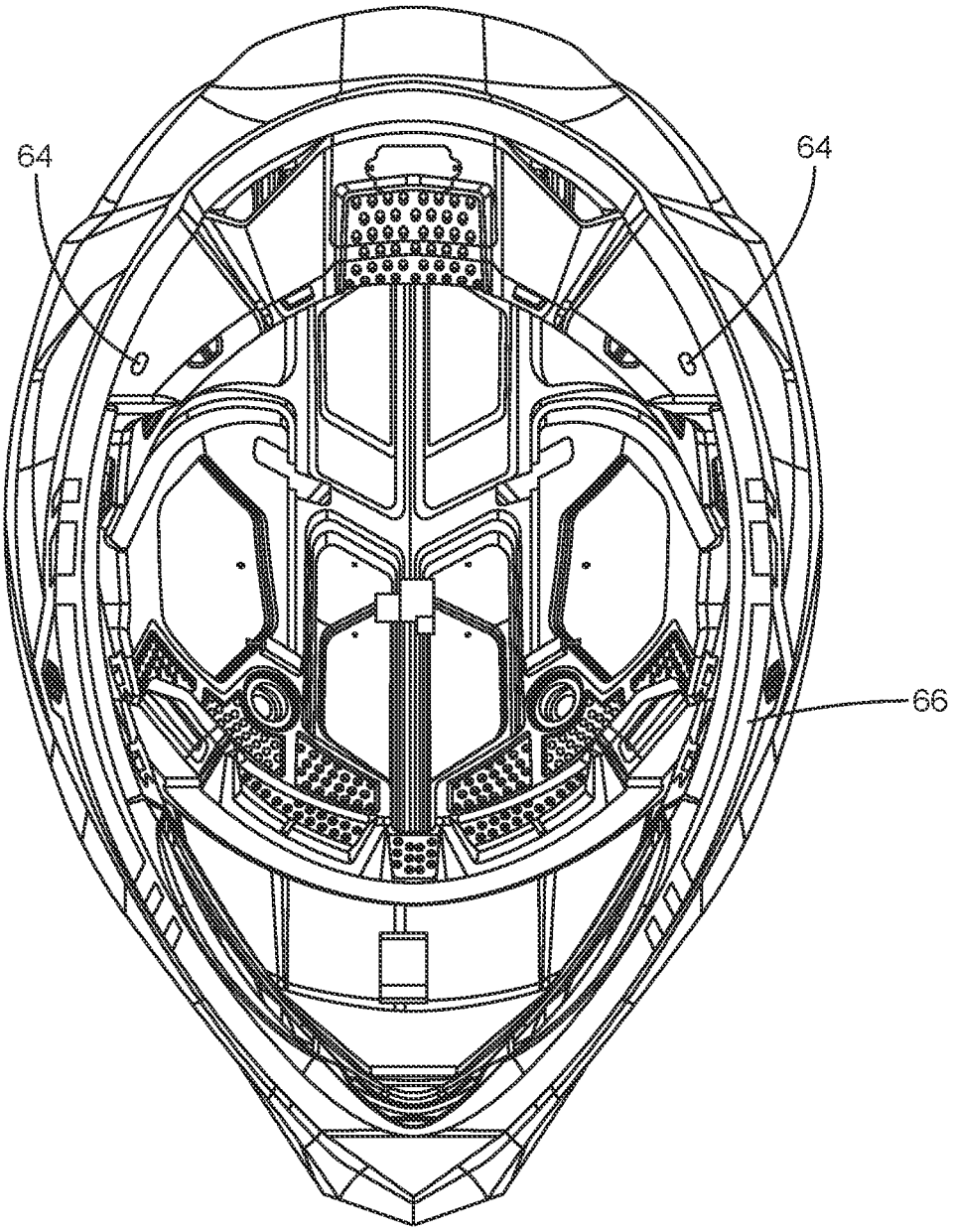

Referring to FIG. 8, an exemplary block diagram of the electronic device 52 in accordance with the present disclosure is illustrated. The electronic device 52 comprises a processing unit 54 and a transceiver 58. The electronic device 52 may be configured to receive the first set of signals generated by the plurality of sensors 50 and further configured to generate a second set of signals. More particularly, the processing unit 54 of the electronic device 52 may be configured to generate the second set of signals. The electronic device 52 may further comprise an I/O interface 56 and a memory unit 60. The first set of signals received from the plurality of sensors 50 may be stored in the memory unit 60. The memory unit 60 may further be configured to store a threshold value of each of the plurality of parameters detected by the plurality of sensors 50. In a preferred embodiment, the processing unit 54 may receive the detected first set of parameters and compare the detected parameters with the corresponding threshold values to determine the corresponding second set of signals. For instance, a second set of signals may configured to be generated if the detected parameters are more than the corresponding threshold values.

In some exemplary embodiments, the electronic device 52 may be configured to generate one or more detecting signals. The one or more detecting signals may work as indication to the plurality of sensors 50 to detect the corresponding parameters. In some embodiments, the electronic device 52 may determine an instance for the plurality of sensors 50 to detect the corresponding parameters. For instance, in case of detection of heavy vibrations from a vibration sensor, the processing unit 54 may generate a detecting signal directing other sensors, e.g., a heartrate sensor, or a respiration sensor, to sense the corresponding parameters, such as a heartrate or a respiration rate, of the wearer to determine the condition of the wearer.

The electronic device 52 is configured to generate the second set of signals corresponding to each of the one or more conditions of the wearer. For instance, an elevated condition is determined if the detected parameters, e.g., the heartrate and the respiration rate of the wearer is more as compared to the corresponding threshold values. Accordingly, the processing unit 54 is configured to generate separate second set of signals corresponding to each of the plurality of conditions of the wearer.

In some embodiments, the electronic device 52 may include a first surface 62 having the I/O interface 56 and at least one visual indicator. The I/O interface 56 may be used to retrieve the first set of signals stored in the memory unit 60 for analysis of the retrieved first set of parameters. Such parameters may be analyzed to determine performance of the wearer in a specific racing event. In some embodiments, the I/O interface 56 may further be used to charge a battery of the electronic device 52. The at least one visual indicator on the first surface 62 of the electronic device 52 may be configured to indicate at least one of the plurality of conditions of the wearer. The I/O interface 56 and the at least one indicator may be accessible from the outside through a first aperture 22 and a second aperture 24 of the outer shell 12 of the helmet 10 (seen e.g., in FIG. 5) The first aperture 22 corresponds to the at least one visual indicator and the second aperture 24 corresponds to the I/O interface 56. The first aperture 22 is configured to indicate the at least one condition of the wearer indicated by the visual indicator visible from outside, even though the electronic device 52 is enclosed within the holder 40. Similarly, the second aperture 24 of the outer shell 12 facilitates access of the I/O interface 56 while the electronic device 52 is enclosed within the holder 40.

The helmet 10 further comprises one or more indicators 64 (seen e.g., in FIGS. 9-12). The one or more indicators 64 may be configured to receive the second set of signals generated by the electronic device 52. Accordingly, the one or more indicators 64 may be configured to indicate the detected condition of the wearer based on the received second set of signals. The one or more indicators 64 are configured to indicate each of the plurality of conditions of the wearer as detected by the plurality of sensors 50 separately. In other words, each of the plurality of conditions is indicated by the one or more indicators 64 differently. As the one or more indicators 64 receive the second set of signals from the electronic device 52, the one or more indicators are controlled by the electronic device 52, and particularly by the processing unit 54. In other words, a mode of operation of the one or more indicators 64 is controlled by the electronic device 52.

The one or more indicators 64 are configured to indicate each of the plurality of conditions such as a normal condition, an elevated condition, an underrated condition of the wearer. Moreover, the one or more indicators 64 further indicate the plurality of conditions associated with an impact or an accident, such as a minor impact, a moderate impact, a severe impact, and the like. Such indication of the detected condition of the wearer facilitates a person watching the racing event to know the current condition of the wearer without any external communication or additional components. Further, such indication is crucial for first responders in case of an impact or an accident. For instance, if the one or more indicators 64 indicate a condition of moderate impact, the first responder may prepare their response accordingly. In case of a condition of severe impact, the first responders may be most effective in responding. Knowing a level of an impact severity upon arrival to a crash scene can greatly accelerate the physical and risk assessment for the first responders, particularly around concussion, traumatic brain injury ("TBI"), and C-Spine injuries.

In some embodiments, the helmet 10 may further comprise a second indicator attached at the outer surface 14 of the outer shell 12. In some embodiments, the second indicator may be attached to the outer surface 14 using an adhesive material. Optionally, the second indicator may be embossed on the outer surface 14. The second indicator may be a warning sign for the first responders. For instance, the warning sign may indicate instructions to the first responders in case of a severe impact, such as 'Do not remove the helmet, if a condition of the severe impact is detected.' In such cases, the first responders may respond accordingly so as to perform appropriate actions to save the wearer's life or to mitigate long-term health effects.

The one or more indicators 64 may be selected from an audio indicator, a visual indicator, or a combination thereof. In some embodiments, the one or more visual indicators may be light emitting diodes (LED) or organic light emitting diodes (OLED). In such embodiments, the plurality of conditions may be detected by indicating different colors of lights on the LEDs. For instance, in case of a minor impact, the LEDs may indicate yellow light. For moderate impact, the LEDs may indicate orange light, and for severe impact, the LEDs may indicate red light. Along with different colors of indication of the plurality of conditions, a frequency of blinking of the LEDs may also be controlled for indicating the plurality of conditions. For instance, for indicating a normal condition, the LEDs may blink at a first predefined interval. For indicating an elevated condition, the LEDs may blink at a second predefined interval. The second predefined interval is less as compared to the first predefined interval. In an embodiment, the LEDs may blink in red color and continuously to indicate a severe impact condition. It is to be noted that the color of light of the LEDs and the frequency of the blinking may be controlled by the electronic device 52, more particularly by the processing unit 54 of the electronic device 52.

Other non-limiting examples of visual indicators are special types of material such as fluorescent, incandescent, bioluminescent, and the like. The visual indicator may further include a phase change structure or material that once imparted by a certain level of impact changes a physical state or a color therefor indicating a certain impact threshold has been met. The visual indicator may be a pop-up device that, for example when impacted, pops out. An audio indicator may be a speaker capable of making announcement such that only the wearer may be able to listen to the announcement.

Figure 11:
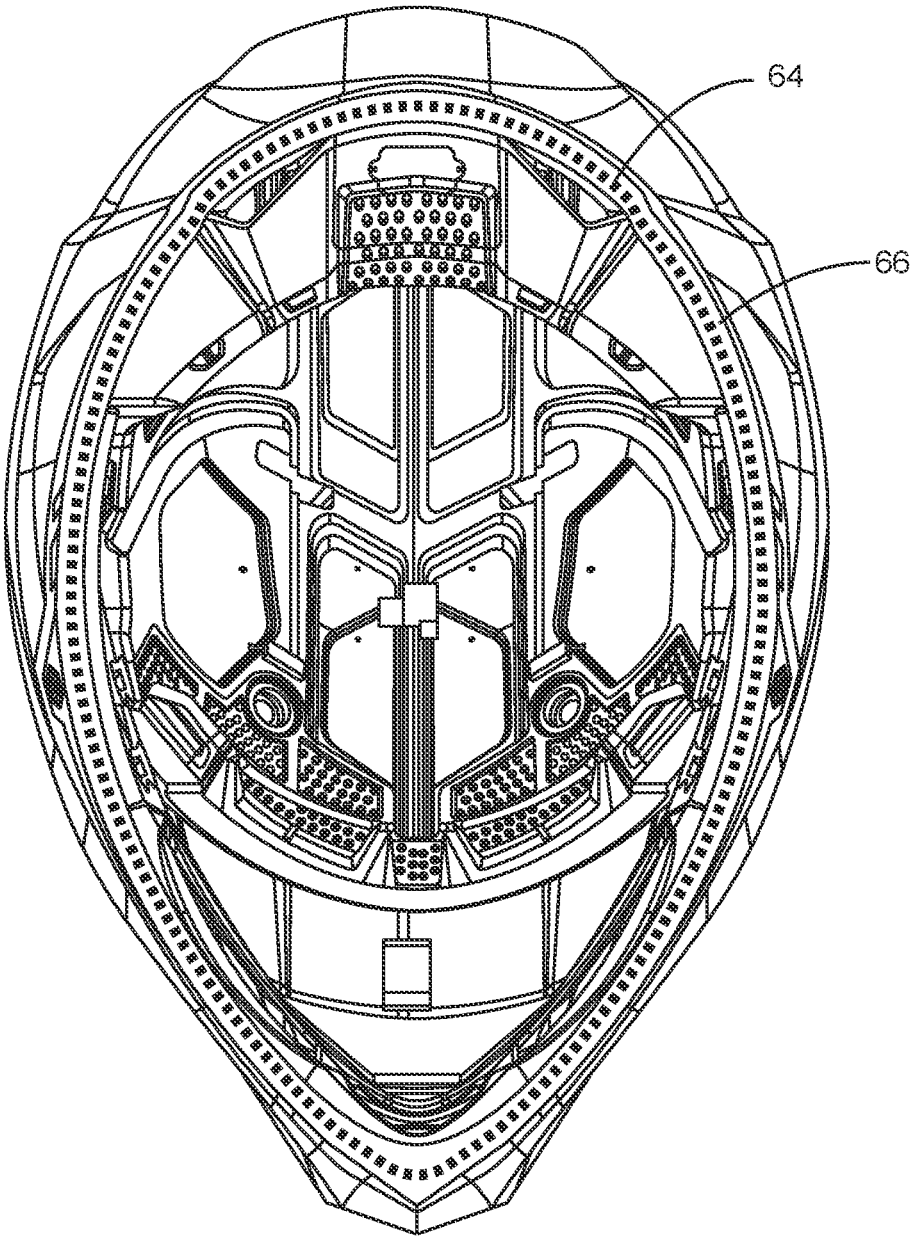
Figure 12:
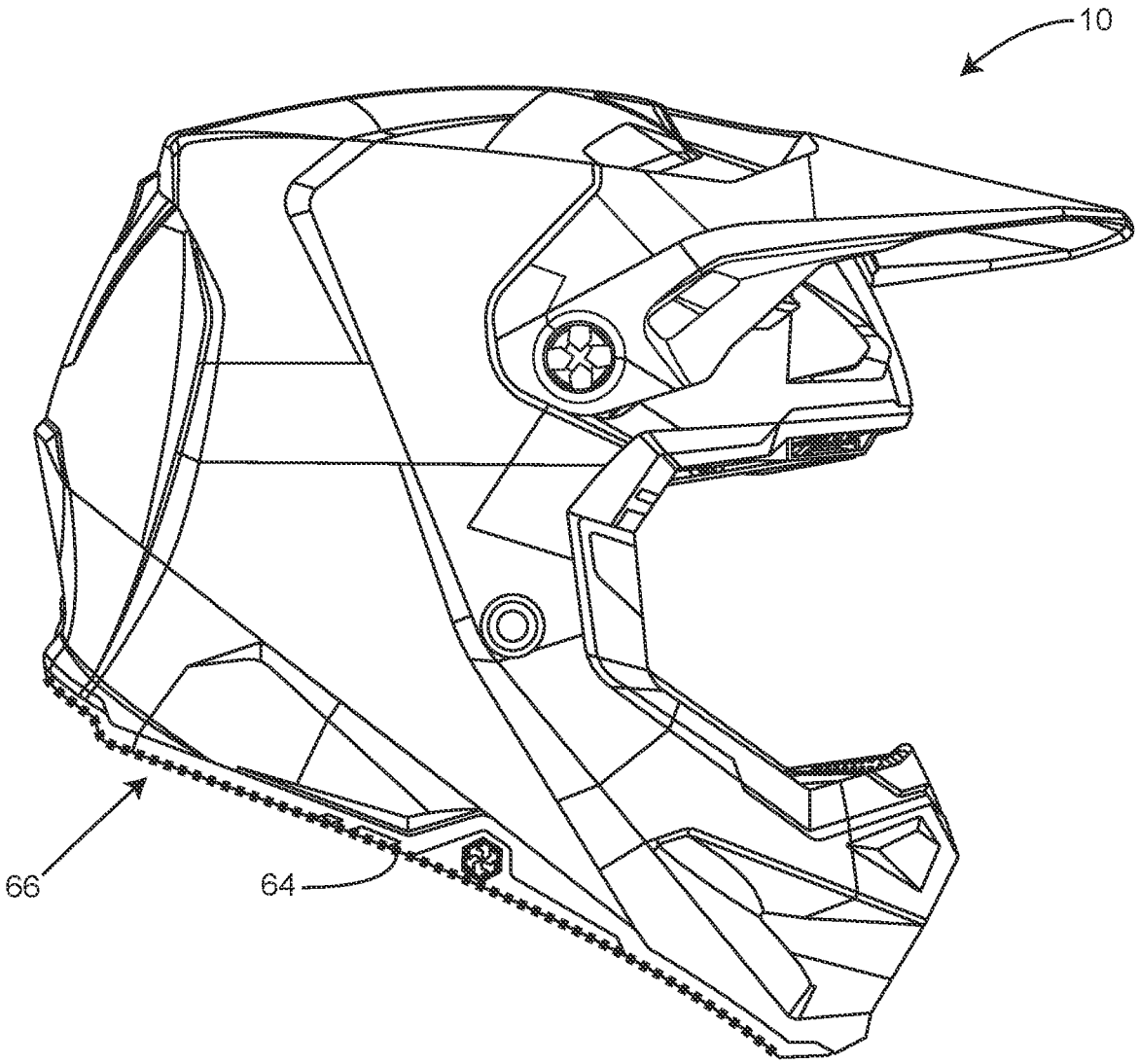

The one or more indicators 64 may be placed at different locations of the outer shell 12 of the helmet 10. FIGS. 9-12 illustrate different exemplary locations of the outer shell 12 where the one or more indicators 64 may be placed. For instance, the one or more indicators 64 may be placed in the front part 18 and the rear part 20 of the outer shell 12 (seen e.g., in FIGS. 2 and 9, respectively). The one or more indicators 64 may be placed at the first side part 26 and the second side part 28 of the outer shell 12 (seen e.g., in FIG. 2). The one or more indicator may further be placed at a bottom trim 66 of the helmet 10 (seen e.g., in FIG. 10). The one or more indicators 64 may be in form of a LED strip that can be placed at the bottom trim 66 of the helmet 10 as shown in FIGS. 11 and 12. It is to be noted the one or more indicators 64 are placed such that the one or more indicators are readily visible to a third person or first responders and the detected condition of the rider/wearer may be determined easily by the third person or the first responders. It is further to be noted that the FIGS. 9-12 show LEDs as one or more indicators for exemplary purpose. Other indicators as explained hereinabove may be used to provide the same effects as the LEDs.

In some embodiments, the helmet 10 may further comprise one or more proximity sensors placed at the outer surface 14 of the outer shell 12. Such proximity sensors may detect if another rider in the racing event is nearby or not. If another rider is nearby, then the proximity sensors generate corresponding firsts set of signals. The electronic device 52 receives the first set of signals and generate corresponding second set of signals, which may be indicated by the one or more indicators 64, for example LEDs/a LED strip, placed at the bottom trim 66 of the helmet 10. In such embodiments, the light emitted by the LEDs/the LED strip may be reflected from the shoulder of wearer. Such reflection may facilitate elimination of a head movement of the wearer and may readily alert the wearer regarding the nearby rider. Hence, the wearer may change a course of a corresponding vehicle to avoid possible collision with the nearby rider.

In some embodiments, the electronic device 52 may be configured to receive a third set of signals from one or more sources via a communication network 68. The third set of signals may indicate one or more unsafe surrounding conditions on a path of the wearer/rider. For instance, there may be a fallen rider in a path. The one or more sources, external to the helmet 10, may send such third set of signals to the helmet 10. In some embodiments, a plurality of sensors associated with another wearer of another helmet 10 may send one or more signals if the rider has fallen. Optionally, sensors placed on a path of the wearer/rider may indicate any obstacle in the path ahead of the rider.

The electronic device 52 of the helmet 10 may receive such third set of signals and generate a corresponding fourth set of signals. The generated fourth set of signals may be transmitted to the one or more indicators 64. The one or more indicators 64, based on the received fourth set of signals, indicate one or more unsafe surrounding conditions. In an embodiment, the one or more indicators 64 may be configured to indicate each of the one or more unsafe surrounding conditions.

In further embodiments, the helmet 10 may include a microphone and a speaker for communication with a third person using a communication network. In such embodiments, the third person may intimate the wearer regarding a fallen rider or any other obstacle in the path or any other riding instructions using the communication network. The wearer may receive the intimation through the speaker. The speakers, in such embodiments, may be placed within the helmet 10 such that the intimation is heard by the wearer only.

In some embodiments, the helmet 10 further comprises a camera placed at the rear part 20 of the outer shell 12 thereof. The camera may be configured to capture a plurality of images or videos. The captured plurality of images or videos may be shown to the wearer. In such embodiments, the captured images or videos may be shown partially on a visor of the helmet 10. Optionally, the captured images or videos may also be shown on a separate screen attached to the helmet 10 at a suitable position. The captured images or videos may further be shown on a screen attached to a steering or a handle of a corresponding vehicle of the wearer.

Figure 13:
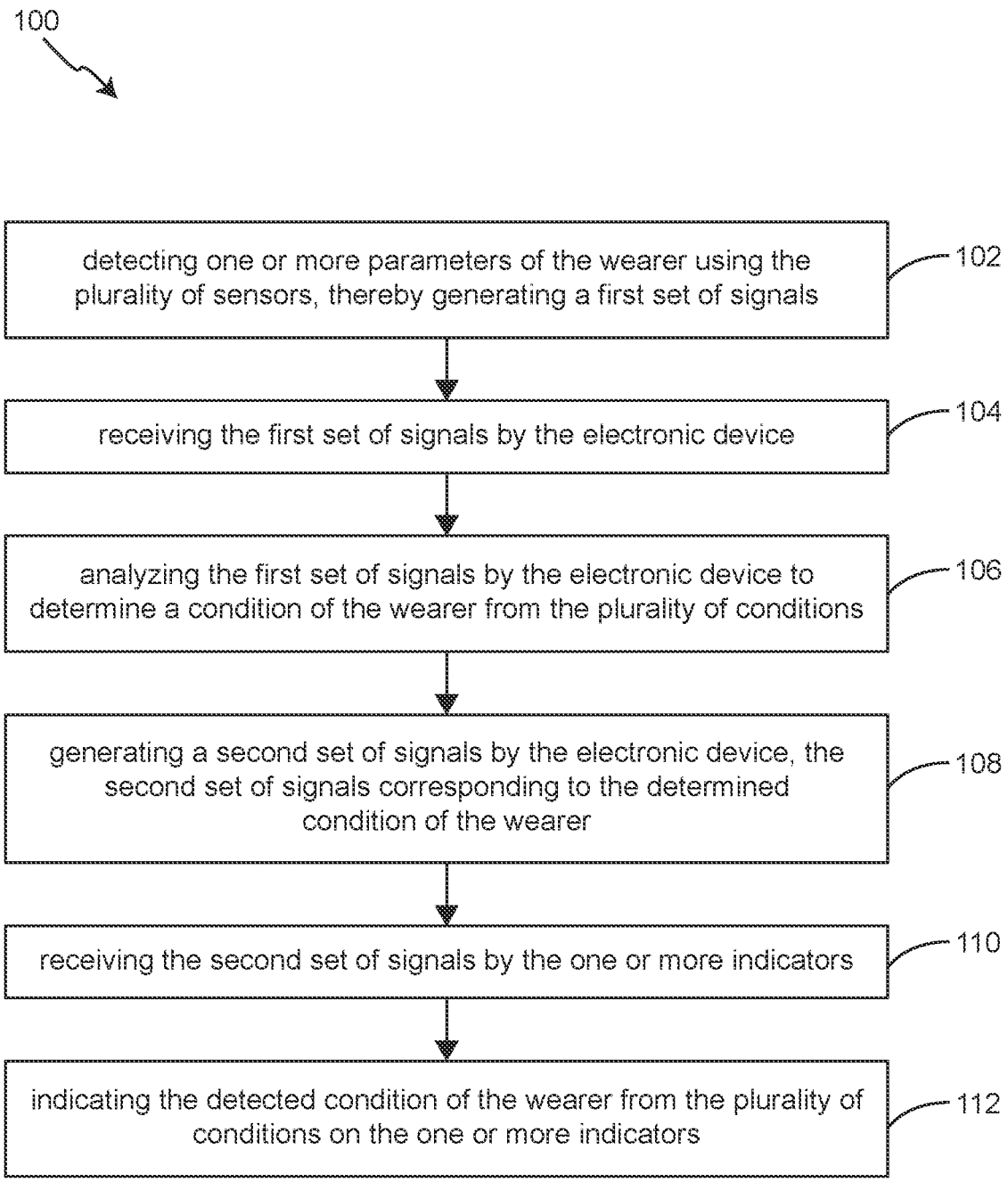
FIG. 13 illustrates an exemplary method for monitoring one or more conditions of a wearer using a helmet in accordance with the present disclosure.

According to a second aspect of the present disclosure, a method of monitoring a plurality of conditions of a wearer using a helmet 10 is disclosed. FIG. 13 illustrates an exemplary method in accordance with the present disclosure. It is to be noted that the method is being performed using the helmet 10 as disclosed hereinabove. Accordingly, all components of the helmet 10 are included and used in performing the method. Therefore, the helmet 10 comprise an outer shell 12, an inner padding arrangement 30, a plurality of sensors 50, one or more indicators 64, and an electronic device 52. The plurality of sensors 50 may be communicatively coupled with the electronic device 52. In some embodiments, the plurality of sensors 50 may have wired connection with the electronic device 52. Optionally, the plurality of sensors 50 may have wireless connection with the electronic device 52. The electronic device 52 may be coupled with the one or more indicators 64 in a wired connection or a wireless connection.

The method may start with step 102 in which the plurality of sensors 50 detect one or more parameters of a wearer of the helmet 10. In some embodiments, the plurality of parameters may be associated with biometric data of the wearer. Optionally or in addition, the plurality of sensors 50 may be associated with one or more external conditions affecting the wearer, such as external impact or external vibrations. Some non-limiting examples of the plurality of sensors 50 are temperature sensor, heartrate sensor, $VO_2$ measurement sensor, $O_2$ measurement sensor, hydration sensor, accelerometer, and the like. The plurality of sensors 50 may be configured to generate a first set of parameters based on the detected plurality of parameters. In some embodiments, the first set of parameters may be a combination of the detected plurality of parameters. In some embodiments, the plurality of sensors 50 may be configured to detect the plurality of parameters continuously. Optionally, the plurality of sensors 50 may detect the plurality of parameters at a predefined interval.

In step 104, the electronic device 52 may be configured to receive the first set of parameters. As mentioned earlier, the electronic device 52 may be in a wired or a wireless connection to receive the first set of signals. In an embodiment, the electronic device 52 may determine an instance for the plurality of sensors 50 to detect the relevant parameters. For instance, in case of detection of heavy vibrations from a vibration sensor, the processing unit 54 may generate a detecting signal directing other sensors, e.g., a heartrate sensor, or a respiration sensor, to sense the corresponding parameters, such as a heartrate or a respiration rate, of the wearer to determine the condition of the wearer.

In step 106, the received first set of signals may be analyzed by the electronic device 52. More particularly, the processing unit 54 of the electronic device 52 may analyze the received first set of signals. The electronic device 52 may comprise a memory unit 60. The memory unit 60 may be configured to store a predefined threshold value of each of the plurality of parameters. In the step of analyzing, the processing unit 54 may compare the received first set of signals to the predefined threshold values. Such comparison may determine whether the detected parameters are within a specified limit or not. The specified limit may be a standard limit for a parameter.

In step 108, the electronic device 52 may generate a second set of signals based on the first set of signals. The second set of signals may indicate a condition of the wearer. As explained hereinabove, one or more conditions may refer to physical conditions of the wearer, such as a normal condition, an elevated condition, an underrated condition, and the like. The plurality of conditions may further include conditions of the wearer with respect to a level of impact or accident, such as a minor impact, a moderate impact, a severe impact, and the like. The electronic device 52 may be configured to generate a second set of signals corresponding to each of the plurality of conditions of the wearer. The electronic device 52 may generate the second set of signals such that the generated second set of signals may be indicated by the one or more indicators 64. Accordingly, the one or more indicators 64 are configured to indicate each of the plurality of conditions of the wearer.

In step 110, the generated second set of signals are received by the one or more indicators 64. It is to be noted that the one or more indicators 64 may have a wired or wireless connection with the electronic device 52. In step 112, the one or more indicators 64 may be configured to indicate the second set of signals indicative of the detected condition of the wearer. As the electronic device 52 is configured to generate a second set of signals for each of the plurality of conditions of the wearer, the one or more indicators 64 may be configured to indicate each of the plurality of conditions of the wearer.

The method further includes the step of transmitting the first set of signals to a user device via a communication network. The transmitted first set of signals may be analyzed at the user device. Such analysis may be used to determine performance of the wearer. For instance, the wearer may indicate an elevated condition or an underrated condition in response to specific condition during the racing event. The parameters detected during the specific condition may be used to train the rider to perform better in future racing events.

In some embodiments, the method may include the step of receiving a third set of signals from one or more sources that are external to the helmet 10. The third set of signals may correspond to one or more unsafe surrounding conditions. Some non-limiting examples of the unsafe surrounding conditions are a fallen rider in a path of the wearer, some obstacle in the path of the wearer, and the like. The third set of signals may be received from the one or more sources comprising a second set of sensors of a second person, a third set of sensors placed on a path of the wearer, a user device in communication with the electronic device 52, and a combination thereof. The method may further include the step of generating a fourth set of signals corresponding to the third set of signals by the electronic device 52, receiving the fourth set of signals by the one or more indicators 64, and indicating the detected unsafe surrounding condition corresponding to the fourth set of signals on the one or more indicators 64. Accordingly, the wearer may know about the unsafe surrounding conditions beforehand and may change a direction of travel to avoid/bypass the unsafe surrounding conditions.

Figure 14:
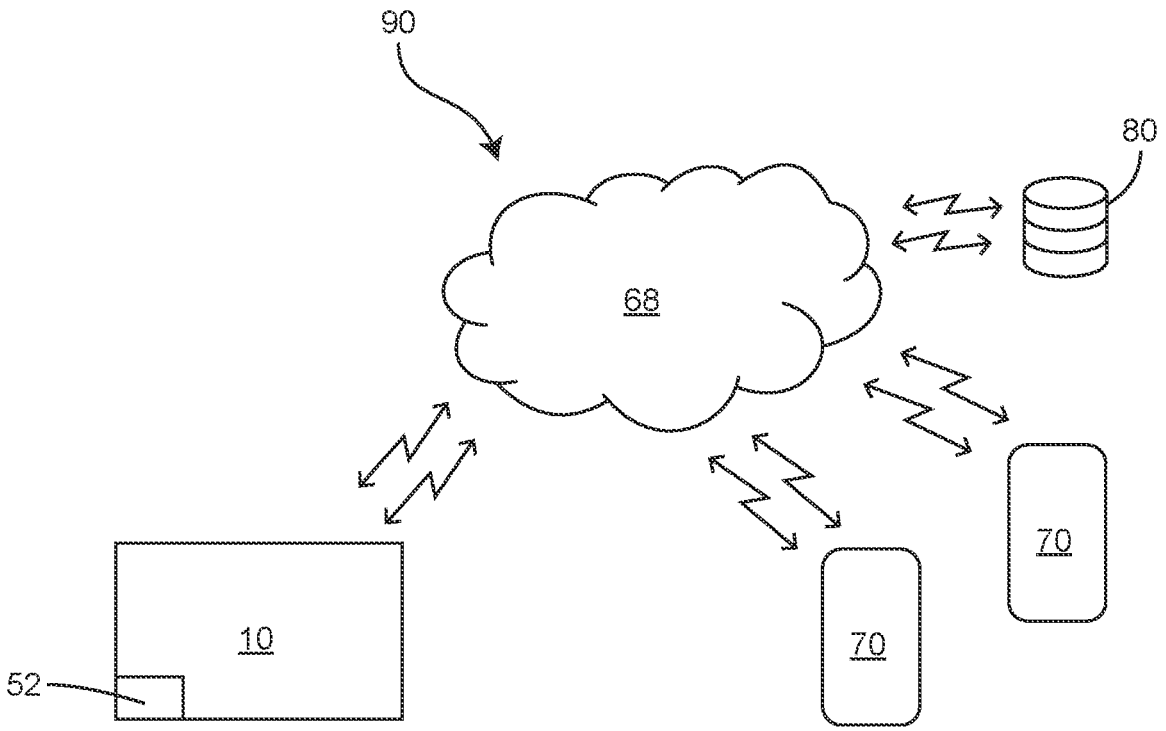
FIG. 14 illustrates an exemplary system for monitoring a plurality of conditions of a wearer in accordance with the present disclosure.

According to a third aspect of the present disclosure, a system 90 for monitoring one or more conditions of a wearer of a helmet 10 is disclosed. An exemplary system 90 in accordance with the present disclosure is illustrated in FIG. 14. The system 90 may include one or more user devices 70, a communication network 68, and a helmet 10 as disclosed hereinabove. As explained hereinabove a rider riding a vehicle may wear a helmet 10 of the present disclosure. The helmet 10 comprises a plurality of sensors 50, an electronic device 52, and one or more indicators 64. The plurality of sensors 50 may be configured to detect a plurality of parameters of the wearer/rider. The detected plurality of parameters may indicate at least one condition from the one or more conditions of the wearer. As explained hereinabove, the one or more condition of the wearer may include a normal condition, an elevated condition, an underrated condition, conditions of the wearer with respect to a level of impact or accident, such as a minor impact, a moderate impact, a severe impact, and the like.

The plurality of sensors 50 may further be configured to generate a first set of signals corresponding to the detected parameters. The electronic device 52 may be configured to receive the first set of signals and may generate a second set of signals. The second set of signals may be received by the one or more indicators 64 to indicate one or more conditions of the wearer. The first set of signals may be transmitted to the one or more user devices 70 using the communication network 68. The one or more user devices 70 may analyze the received first set of signals to determine performance of the wearer/rider during the racing event. Some non-limiting examples of the one or more user devices 70 are a smart phone, a hand-held phone, a personal digital assistant (PDA), a tablet computer, a desktop computer, a smart TV, a smart wearable device, a laptop computer, and the like.

In some embodiments, the system 90 may further include a database 80 connected to the one or more user devices 70. The first set of signals may be stored in the database 80. The database 80 may further be configured to store the analysis performed by the one or more user devices 70 therewithin. The stored first set of signals and corresponding analysis may be retrieved from the database 80. The one or more devices may be connected to the database 80 using the communication network 68. The communication network 68 may be a wired or a wireless network. Some non-limiting examples of the communication network 68 are Internet, Intranet, PSTN, Local Area Network (LAN), Wide Area Network (WAN), Metropolitan Area Network (MAN), and the like.

It is to be noted that different values and parameters mentioned in the description are exemplary in nature and are not intended to bound the specification in any manner.

It is further to be noted that the present disclosure has been described with respect to a helmet of a wearer in a racing event, however, the present disclosure may be applicable to other different types of events where use of helmet is necessary.

Finally, while the present invention has been described above with reference to various exemplary embodiments, many changes, combinations, and modifications may be made to the exemplary embodiments without departing from the scope of the present invention. For example, the various components may be implemented in alternative ways. These alternatives can be suitably selected depending upon the particular application or in consideration of any number of factors associated with the operation of the device. In addition, the techniques described herein may be extended or modified for use with other types of devices. These and other changes or modifications are intended to be included within the scope of the present invention.

What is claimed is:

1. A helmet for monitoring a plurality of conditions of a wearer, the helmet comprising:

an outer shell defining an outer shape of the helmet, the outer shell comprising an outer surface, an inner surface, a front part, a rear part, a first side part, and a second side part;

an inner padding arrangement configured to receive the wearer's head therewithin, the inner padding arrangement comprising an inner liner and a foam arrangement, the foam arrangement comprising a holder;

a plurality of sensors placed within the outer shell, the plurality of sensors configured to detect a plurality of parameters associated with the wearer, and further configured to generate a corresponding first set of signals associated with each of the detected plurality of parameters;

an electronic device communicatively coupled to the plurality of sensors, the electronic device comprising at least a processing unit, and a transceiver, the electronic device configured to be received within the holder of the inner padding arrangement, the electronic device configured to receive the first set of signals from the plurality of sensors, and further configured to generate a second set of signals indicative of at least one of the plurality of conditions of the wearer; and one or more indicators communicatively coupled with the electronic device, the one or more indicators configured to receive the second set of signals from the electronic device and further configured to generate a corresponding indication associated with each of the plurality of the conditions of the wearer.

2. The helmet of claim 1, wherein the inner padding arrangement is configured to be placed adjacent to the inner surface of the outer shell.

3. The helmet of claim 1, wherein the processing unit is configured to analyze the first set of signals to generate the second set of signals corresponding to each of the plurality of conditions of the wearer.

4. The helmet of claim 1, wherein the holder is placed adjacent to a bottom trim at a bottom portion of a back part of the inner liner.

5. The helmet of claim 1, wherein the holder comprises a cavity and a closing mechanism, the cavity and the closing mechanism configured to enclose the electronic device therewithin.

6. The helmet of claim 5, wherein the closing mechanism comprises a door and a corresponding flap.

7. The helmet of claim 6, wherein the door is a hinged door and is configured to be attached to the corresponding flap attached to the outer shell at a bottom part of the rear part.

8. The helmet of claim 1, wherein the electronic device comprises a first surface having at least one visual indicator and an I/O interface, wherein the first surface is placed adjacent the inner surface of the outer shell when enclosed in the holder.

9. The helmet of claim 8, wherein the outer shell comprises a first aperture and a second aperture at a bottom part of the rear part, the first aperture being corresponding to the at least one visual indicator and the second aperture corresponding the I/O interface of the electronic device.

10. The helmet of claim 1, wherein the one or more indicators are selected from the group consisting of an audio indicator, a video indicator, and a combination thereof.

11. The helmet of claim 1, wherein the one or more indicators are configured to be placed at the outer surface of the outer shell.

12. The helmet of claim 1, wherein the one or more indicators are configured to be placed at a bottom trim of the helmet.

13. The helmet of claim 1, comprising a microphone and a speaker for facilitating a communication of the wearer with a third person using a user device via a communication network.

14. The helmet of claim 1, wherein the electronic device comprises a memory unit to store the first set of signals, wherein the stored first set of signals are configured to be retrieved from the memory unit using an I/O interface.

15. The helmet of claim 1, wherein the processing unit is configured to receive a third set of signals from one or more sources via a communication network and is further configured to generate a fourth set of signals, the third set of signals indicative of one or more unsafe surrounding conditions.

16. The helmet of claim 15, wherein the one or more indicators are configured to receive the fourth set of signals and further configured to indicate the one or more unsafe surrounding conditions corresponding to the fourth set of signals.

17. The helmet of claim 15, wherein the one or more sources comprise at least one of a second set of sensors of a second person, a third set of sensors placed on a path of the wearer, a user device in communication with the electronic device, and a combination thereof.

18. The helmet of claim 1, further comprising a chinstrap placed at a bottom portion of each of the first side part and the second side part of the outer shell, the chinstrap comprising one or more of the plurality of sensors for detecting corresponding parameters of the wearer.

19. The helmet of claim 1, wherein the electronic device is configured to cause the one or more indicators to generate a first indication in response to the electronic device determining a the wearer has incurred a minor impact or accident, is configured to cause the one or more indicators to generate a second indication in response to the electronic device determining the wearer has incurred a moderate impact or accident, and is configured to cause the one or more indicators to generate a third indication in response to the electronic device determining the wearer has incurred a severe impact or accident, wherein the first indication, the second indication, and the third indication are each different from each other.

20. The helmet of claim 1, wherein the electronic device is configured to cause the one or more indicators to generate multiple different indications, wherein each of the different indications respectively corresponds to a different severity of an impact or accident of the wearer.

21. The helmet of claim 1, wherein the one or more indicators are configured to generate the corresponding indication associated with each of the plurality of the conditions of the wearer such that each indication is visible outside the helmet by spectators of the wearer.

* * * * *